US006976611B2

(12) United States Patent
Lee

(10) Patent No.: US 6,976,611 B2
(45) Date of Patent: Dec. 20, 2005

(54) PRESSURE DISPENSING CAP FOR LIQUID CONTAINER

(76) Inventor: Jung Min Lee, 1208 Misung, Apt. A-dong, 37 Yeoueudo-dong, Youngdungpo-gu, Seoul 150-010 (KR)

( * ) Notice: Subject to any disclaimer, the term of this patent is extended or adjusted under 35 U.S.C. 154(b) by 0 days.

(21) Appl. No.: 10/416,677

(22) PCT Filed: Nov. 26, 2001

(86) PCT No.: PCT/KR01/02033

§ 371 (c)(1),
(2), (4) Date: May 14, 2003

(87) PCT Pub. No.: WO02/42173

PCT Pub. Date: May 30, 2002

(65) Prior Publication Data

US 2004/0011827 A1 Jan. 22, 2004

(30) Foreign Application Priority Data

Nov. 27, 2000 (KR) ..... 2000/72207
Nov. 27, 2000 (KR) ..... 2000/72208
Nov. 27, 2000 (KR) ..... 2000/72209
Dec. 23, 2000 (KR) ..... 2000/84764

(51) Int. Cl.[7] ..... B67D 3/00
(52) U.S. Cl. ..... 222/536; 222/553
(58) Field of Search ..... 222/536, 537, 222/548, 553, 554, 555

(56) References Cited

U.S. PATENT DOCUMENTS 4,412,634 A * 11/1983 Bennett ..... 222/519
4,903,870 A * 2/1990 La Vange ..... 222/482
5,090,601 A * 2/1992 Thanisch ..... 222/507
5,582,315 A * 12/1996 Reid ..... 220/254.4
5,855,304 A * 1/1999 Dean et al. ..... 222/481
2003/0057235 A1 * 3/2003 Gueret ..... 222/182

* cited by examiner

*Primary Examiner*—Joseph A. Kaufman
(74) *Attorney, Agent, or Firm*—Norris McLaughlin & Marcus PA

(57) ABSTRACT

A pressure dispensing cap for a liquid container, and more particularly to a pressure dispensing cap for liquid container that is designed such that its spout is inclined to one side at a predetermined angle thereby easily dispensing the contents of the container, and is possible to selectively open and close an inlet and an outlet over again and is more suitable to a long term storage container for a liquid like an edible oil and molasses.

11 Claims, 6 Drawing Sheets

PRESSURE DISPENSING CAP FOR LIQUID CONTAINER

TECHNICAL FIELD

The present invention relates to a pressure dispensing cap for liquid container, and more particularly to a pressure dispensing cap for liquid container that is designed such that its spout is inclined to one side at a predetermined angle thereby easily dispensing the contents of the container, and is possible to selectively open and close an inlet and an outlet over again and is more suitable to a long term storage container for a liquid like an edible oil and molasses, etc.

BACKGROUND ART

Generally, a hinged closure has been in use for a long-term storage container for a liquid like and edible oil and molasses, etc. But the prior hinged closures have a problem that some contents still remain in the top surface end of the closure main body after the user dispenses the content of the container and closes the closure.

Further, owing to the remaining contents, the outer surface of the container can be polluted.

The prior closure can not control the discharge of the content so that the content of the container flows out of the container and pollutes the outside of the container.

To solve the above problem, KR Utility Model Publication No. 89-6831 disclosed a cap for liquid container that is designed such that it can uniformly flow out the content of the container.

Features of the utility model are that if the outer pressure is applied to the container, the content is dispensed through the extra spout, and the pressure is released, the remained content is sucked by the absorption force.

However, when the container is fallen, as the content remained in the cap is not drained, the content pollutes the container.

Another prior art of the present invention is disclosed in U.S. Pat. Nos. 5,332,131; 3,851,805; 3,873,005; 3,874,568; 3,881,643; 3,884,392; 4,081,108; 4,081,108; 4,756,451; 4,776,475; 4,903,870; 5,190,176; 5,524,799; 5,873,478 and KR Patent Application No. 2000-56308 of the inventor of the present invention.

The prior arts have an advantage that the cap can be opened and closed by one-touch manner, but those have disadvantages that the sealing is bad and the spout must be manually erected every time.

DISCLOSURE OF INVENTION

Therefore, the present invention has been made in an effort to solve the problem. It is an object of the present invention to provide a cap designed such that the content of the container does not dispense through the outflow hole of the spout during storage after initial opening although the container is fallen.

It is another object of the present invention to provide a cap that is designed such that the spout is maintained in a predetermined angle thereby easily sucking the remained content into the container.

To achieve the above objects, the present invention provides a pressure dispensing cap for liquid container comprising a main body coupled to the container and a spout that is rotatably assembled to a spout fixing portion protruded from the main body thereby functioning as a closing and dispensing means. A seal cover is integrally formed with the main body and connected to the main body by a hinge portion. The spout fixing portion is provided with an outflow hole and a spout fixing protrusion at an upper portion and an lower portion thereof respectively. A spout fixing protrusion fixing groove portion with a fixing groove is formed at both sides of the spout fixing portion. The outflow hole is opposed to the hinge portion connect the cover to the main body. The spout is provided at its inside with a spout fixing portion inserting groove, the spout fixing portion inserting groove is connected to the outflow portion formed in the inclined tube, and a spout fixing protrusion inserting groove is formed at the inner wall of the spout fixing portion inserting groove. A fixing protrusion for elastically fixing to an inner groove of the spout fixing protrusion fixing groove is formed at an outer end of the lower portion of the spout.

In another embodiment of the present invention, a pressure dispensing cap for liquid container comprises a main body coupled to the container and a spout that is assembled to a spout fixing portion protruded from the main body and it can be ascended and descended by pulling and pushing operation thereby functioning as a closing and dispensing means. The spout fixing portion is formed with the outflow hole at its inner center and a first and a second annular bands are formed at its periphery. The spout assembled to the spout fixing portion is provided with the spout fixing portion inserting groove for inserting the spout fixing portion thereinto, the spout fixing portion inserting groove is connected to the central passage formed inside of the inclined tube, an annular protrusion is formed at the lower inner wall of the spout fixing portion inserting groove, and a sealing portion for closing the outflow hole of the spout fixing portion is formed at the upward lower surface of the spout fixing portion inserting groove having the annular groove.

In still another embodiment of the present invention, a pressure dispensing cap for liquid container comprises a main body coupled to the container and a spout that is elastically assembled to a spout fixing portion formed in the top surface of the main body and sealed then it is manually moved in a predetermined angle thereby functioning as a dispensing means. The spout fixing portion is provided with the spout inserting portion inserting groove and a support protrusion inserting groove, and a sealing protrusion inserting hole and a sealing protrusion inserting groove. The spout is provided with an inserting portion that is tightly inserted to the spout inserting portion inserting groove, and is moved at a predetermined angle, and a central passage is formed in the inserting portion and a second sealing portion that is tightly inserted into the sealing protrusion inserting groove and maintained the state of fixing to the first sealing protrusion for maintaining the sealing until the cap is open is formed below the support protrusion formed in both sides of the inserting portion.

In another embodiment of the present invention, a pressure dispensing cap for liquid container comprises a main body coupled to the container, a spout in which a cover fixing band is formed at the top surface of the main body, the spout having an outflow hole is formed inside of the cover fixing band, and the spout is tilted in a right angle and a cover having the outflow hole closing protrusion for closing the end of the outflow hole of the spout.

BRIEF DESCRIPTION OF DRAWINGS

The accompanying drawings, which are incorporated in and constitute a part of the specification, illustrate an embodiment of the invention, and, together with the description, serve to explain the principles of the invention:

FIG. 1 shows an opening state; and

FIG. 2 shows a closing state;

FIG. 3 shows that the cover is open and the spout is rotated in an opening direction;

FIG. 4 shows that the cover is closed and the central passage of the spout is closed by the central passage closing protrusion of the cover;

BEST MODE FOR CARRYING OUT THE INVENTION

Figure 1:
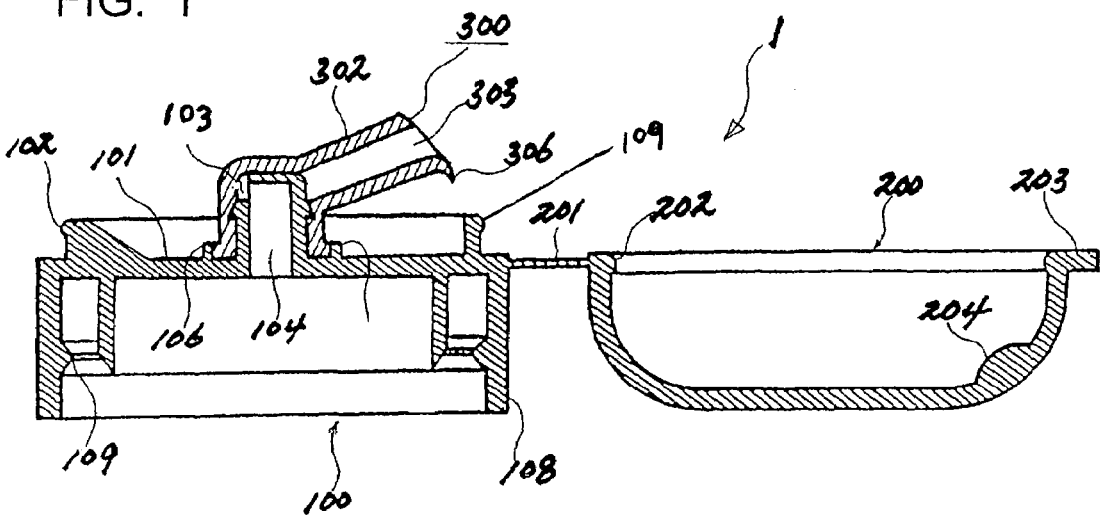
FIGS. 1 and 2 are vertically sectional views illustrating the construction in a first embodiment according to the present invention, where.

A preferred embodiment of the present invention will be described in detail with reference to the accompanying drawings.

First Embodiment

FIGS. 1 to 4 shows a pressure dispensing cap in a first embodiment according to the present invention.

The illustrated cap of the present invention is assembled to the neck of the container by a method of one touch pressing or screw assembly.

A liquid dispensing cap 1 is composed of a main body 100 and a cover 200 which are connected by a hinge portion 201, and a spout 300 is assembled to a spout fixing portion 103.

A cover fixing band 102 is formed at a top surface portion 101 of the main body 100, the spout fixing portion 103 is formed on the inward side of the cover fixing band 102, an outflow hole is formed at an upper portion of the spout fixing portion 103, and a spout fixing protrusion 105 is formed at the lower portion thereof. Further, there is a spout fixing protrusion fixing groove 106 provided at its inside with a fixing groove 107 at both sides of the spout fixing portion 103.

The cover is formed at the opposite direction portion of the outflow hole 104, or at the upper end of the side portion 108 of the main body 100, where an annular jaw 202 is formed at the inner wall of the cover in order to be fixed to the cover fixing band 102 and an outflow hole closing protrusion 204 is formed near a guide portion 203.

Further, the spout 300 is provided at its inside with a spout fixing portion inserting groove 301, the groove 301 is connected with an outflow hole formed in a tube 302, a fixing protrusion 305 for elastically fixed to the inner fixing groove 107 of the spout fixing protrusion fixing groove is formed at the inner wall of the spout fixing portion inserting groove 301, and a leakage preventing portion 306 is formed at an end of the tube 302.

In the present invention as described above, it is preferred that the outflow hole 104 formed upward of the spout fixing portion 103 is formed at the opposite direction of the hinge portion 201 in principle.

Preferably, the outflow hole 104 is designed such that a portion of the hole is askew cut shaped. This configuration provides an easily opening and closing operation for a first opening and a continuously sealing before opening.

It is preferred that the tube 302 is oriented to the hinge portion 201 to protect the outflow hole 104 from the outer air when the spout 300 is first assembled to the spout fixing portion 103.

Further, the cap 1 is equipped with a fixing portion for preventing the movement of the spout 300 after it is assembled to the spout fixing portion 103 wherein the fixing mechanism can be a generally known fixing portion.

That is, it is sufficient that the user can perceive the spout 300 in position such that the tube 302 rotates to the opposite direction to the hinge portion 201 and stops at an opposite position with respect to the hinge portion 201. Preferably, as an embodiment, the spout fixing protrusion fixing groove 106 with the fixing groove 107 is formed at the outer bottom surface of the spout fixing portion 103, and a fixing protrusion 305 is formed at the corresponding lower portion of the spout 300.

Further, it is preferred that a leakage preventing portion 306 is shaped of a curled end for preventing leakage while the content is re-drained.

Now, the operation of the present invention will be described below.

FIG. 1 shows that the spout 300 is tightly assembled to the spout fixing portion 103. As the fixing protrusion 305 is elastically and tightly inserted into the fixing groove 107, the tube 302 of the spout 300 is fixed thereto in an opposite direction to the hinge portion 201.

Figure 2:
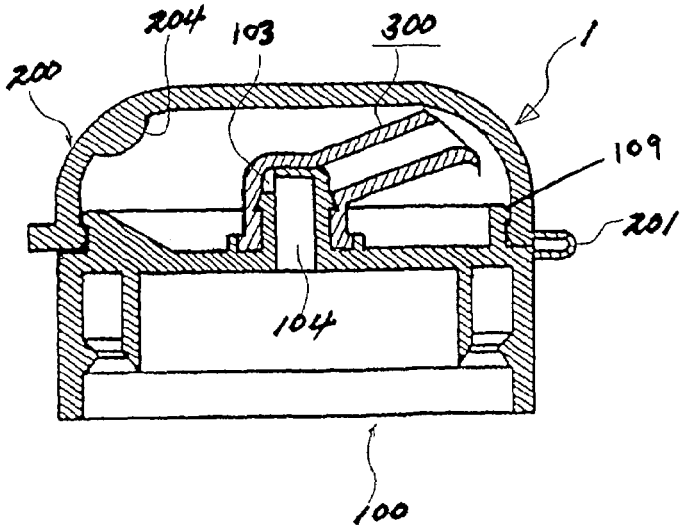

In FIG. 2, the cover 200 is in closing position in state of FIG. 1. The cap 1 can be fixed to the neck of the container by pressing manner or the like. That is, the engagement jaw 109 of the cap 1 is fixed to an annular jaw formed in the neck of the container.

In this state, when the user wants to open and use the content of the container, the cover 200 is erected by lifting the guide portion 203. The annular jaw 202 of the cover 200 is elastically freed from the cover fixing band 102 of the main body 100 and the cover 200 is open. If the tube 302 of the spout 300 rotates in an opposite direction of the hinge portion 201, each fixing protrusion 305 is inserted into the opposite fixing groove 107 and the spout 300 stops. This is illustrated in FIG. 3.

Figure 3:
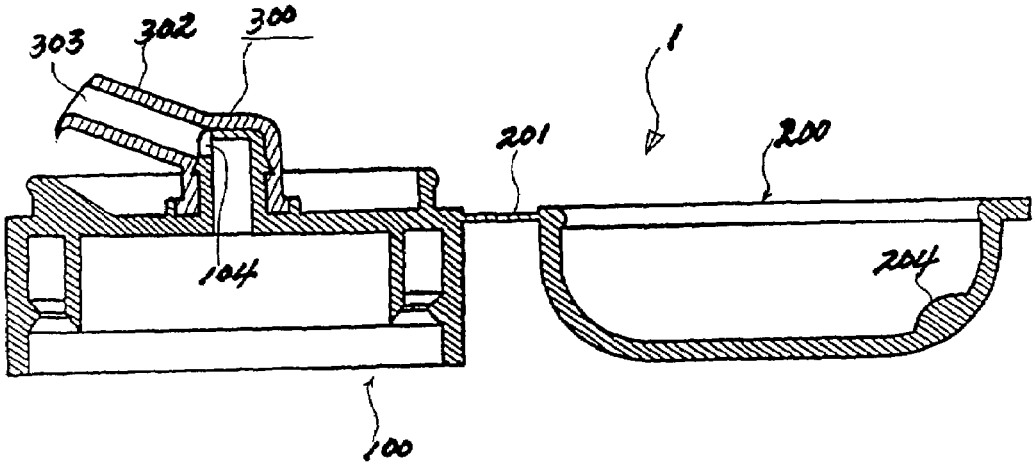
FIGS. 3 and 4 are sectional views of a pressure dispensing cap for liquid container in a first embodiment according to the present invention where it is in using state, where.

As shown in FIG. 3, the spout 300 remains in this configuration until the content of the container is exhausted. At this point, the outflow hole 303 of the spout 300 communicates with the outflow hole 104 of the spout fixing portion 103.

In this state, if the container is inclined in a direction and the outer pressure is applied to a side surface of the container, the content of the container is dispensed through the outflow hole 303.

Continuously, when releasing the outer pressure, the container is recovered to the original configuration and the absorption force is produced at the outflow hole 303. And then the remained content of the outflow hole 303 is absorbed into the container whereby the content does not flow out of the cap 1 and the outer surface of the container is not polluted.

Figure 4:
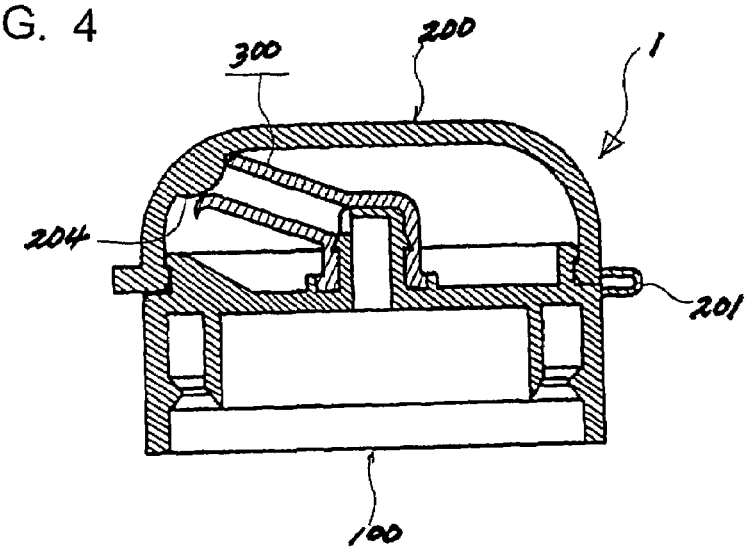
Figure 5:
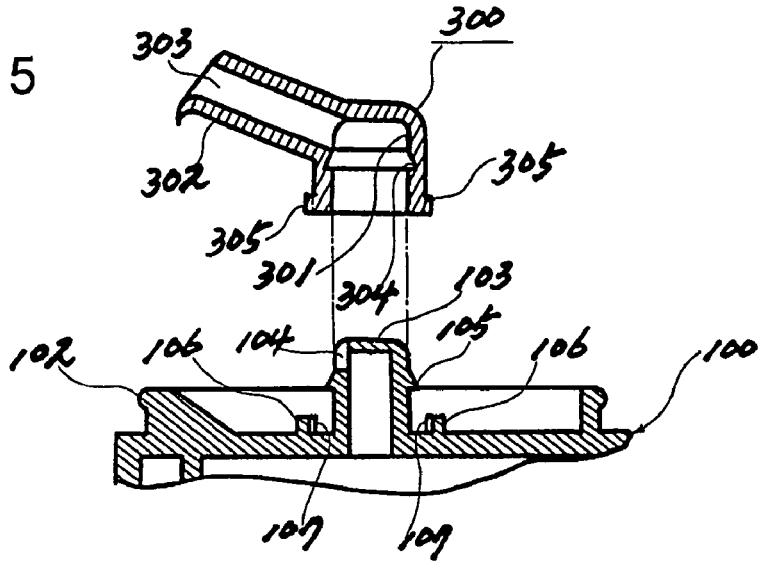
FIG. 5 is a partial separated sectional view that illustrates the assembling state of the spout in the first embodiment according to the present invention.

Further, after using the container, if the cover 200 closes the main body 100, the central passage closing protrusion 204 closes the top end of the tube 302 thereby maintaining the sealing. This is illustrated in FIG. 4.

A various kinds of coupling method can be applied to the coupling between the cap and the container, such as a one-touch manner, a screw manner, an inserting manner, a adherence manner and the like.

Second Embodiment

Figure 6:
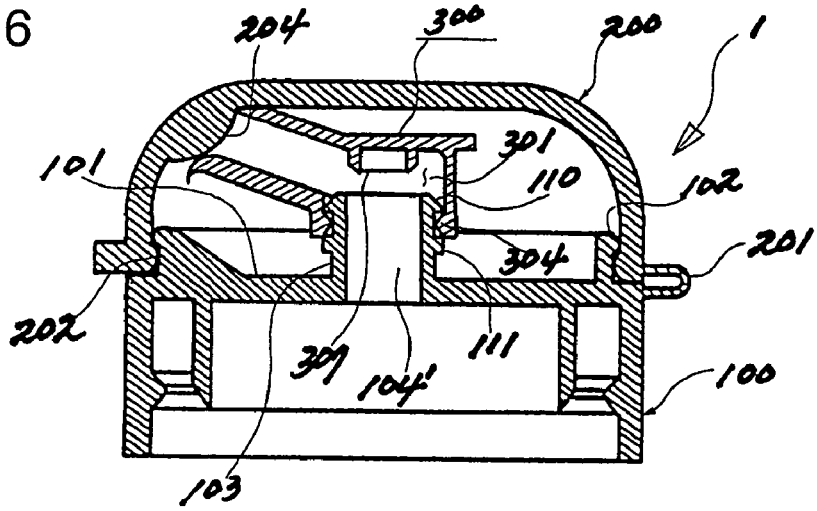
FIGS. 6 and 7 show the pressure dispensing cap in a second embodiment according to the present invention.
Figure 7:
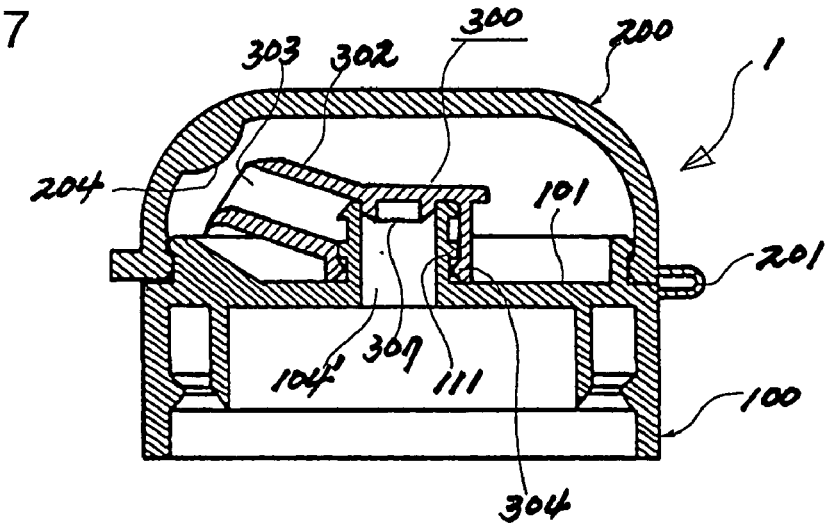

FIGS. 6 and 7 shows another embodiment according to the present invention.

A cover fixing band 102 is formed in a top surface portion of the main body 100, a spout fixing portion 103 with an outflow hole 104' is centrally formed at the inward of the main body 100 and first and second annular bands 110 and 111 is formed at a periphery thereof.

Further, the spout 300 is provided with the spout fixing portion inserting groove 301 for inserting the spout fixing portion 103 thereinto, the spout fixing portion inserting groove 301 is connected to the central passage 303 formed inside of the inclined tube 302, an annular protrusion 304 is formed at the lower inner wall of the spout fixing portion inserting groove 301, and a sealing portion 307 for closing the outflow hole 104' of the spout fixing portion 103 is formed at the upward lower surface of the spout fixing portion inserting groove 301 having the annular groove 304.

An annular jaw 202 and a central passage closing protrusion 204 is formed at the cover 200 connected with the hinge portion 201 of the main body 100, in which the central passage closing protrusion 204 is formed at a position where it reaches to the top end portion of the central passage 303 when the spout 300 is erected.

Preferably, a key groove, or an elliptic spout fixing portion 103 and spout fixing portion inserting groove 301 is provided therewith in order that the spout 300 is not moved sideward.

In this state, when the user wants to open and use the content of the container, the cover 200 is erected and the spout 300 is lifted. The annular protrusion 304 is elastically erected over the second annular band 111 and then stops moving as the annular protrusion 304 is engaged with the first annular band 110.

At this point, the outflow hole 104' communicates with the central passage 303 of the spout 300 as the sealing portion 307 is lifted.

In this state, when the container coupled with the cap 1 is inclined and the outer pressure is applied thereto, the content of the container is dispensed through the central passage 303.

Further, in this state, if the cover 200 is coupled to the main body 100, the central passage closing protrusion 204 doses the top end portion of the central passage 303 thereby accomplishing the re-sealing. This is illustrated in FIG. 6.

Preferably, as shown in FIG. 6, if the spout 300 rotates in a predetermined angle, the spout 300 is lifted to form an outflow passage. This is accomplished through that a thread is formed at the spout fixing portion inserting groove and a thread is formed at the corresponding spout fixing portion.

In this case, there is a lift preventing engagement jaw for preventing the spout 300 from being lifted over the predetermined length. This is general manner, so detailed description is omitted in this specification.

The threads described above can be modified in several configuration, but those are included in the aspects of the present invention.

That is, the sealing portion 307 is protruded long and a thread is formed at a periphery of the sealing portion. A thread is formed at the inner wall of the outflow hole 104' and a spouting groove is formed near the lower thread of the sealing portion 307 thereby accomplishing the spouting passage.

Third Embodiment

Figure 8:
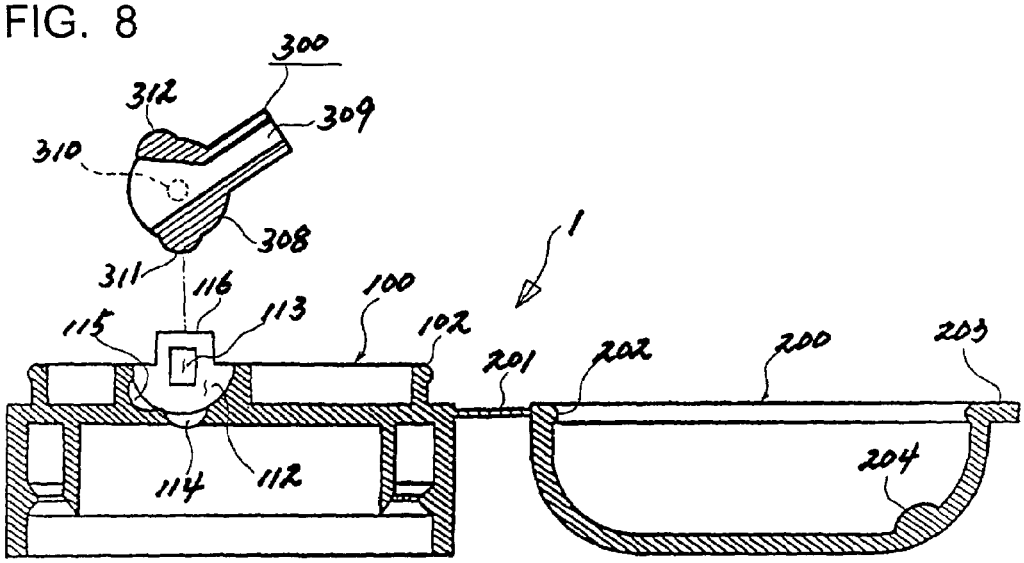
FIG. 8 is a separated sectional view of the cap in a third embodiment according to the present invention.
Figure 11:
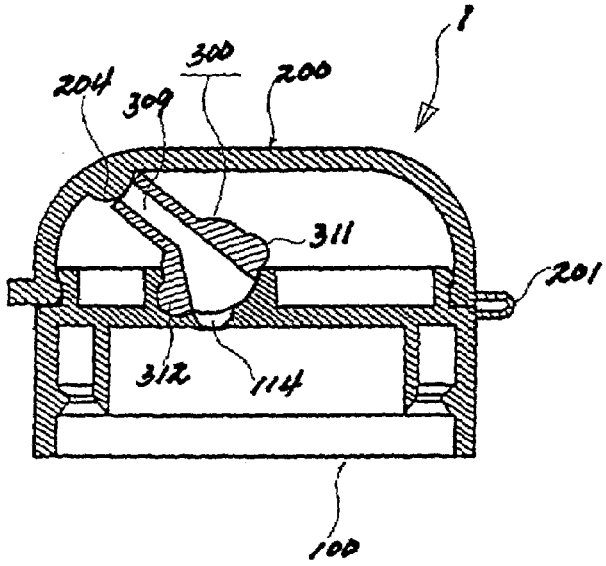
FIG. 11 is a sectional view that the cap is resealed according to the third embodiment of the present invention.

FIGS. 8 and 11 shows another embodiment of the present invention.

A liquid dispensing cap 1 is composed of a main body 100 and a cover 200 which are connected by a hinge portion 201, and a spout 300 is assembled to a spout fixing portion 103 thereby maintaining the sealing force.

A cover fixing band 102 is formed at a top surface portion 101 of the main body 100, the spout inserting portion inserting groove 112 and a support protrusion inserting groove 113 and a spout fixing portion 116 provided with a sealing protrusion inserting hole 114 and a sealing protrusion inserting groove 115 are formed on the inward side of the cover fixing band 102.

An annular jaw 202 fixed and engaged with a main body cover fixing band 102 is formed at the cover 200, a guide portion 203 is formed at the outside of the annular jaw 202, and a central passage closing protrusion 204 is formed at a direction of an inner guide portion 203 of the annular jaw 202.

Further, the spout 300 is provided with an inserting portion 308 that is tightly inserted to the spout inserting portion inserting groove 112 and, as occasion demands, is moved at a predetermined angle. A central passage 309 is formed in the inserting portion 308 and a second sealing portion 312 that is tightly inserted into the sealing protrusion inserting groove 114 and maintained the state of fixing to the first sealing protrusion 311 for maintaining the sealing until the cap is open is formed below the support protrusion 310 formed in both sides of the inserting portion 308.

Now, the operation of the present invention will be described below.

Figure 9:
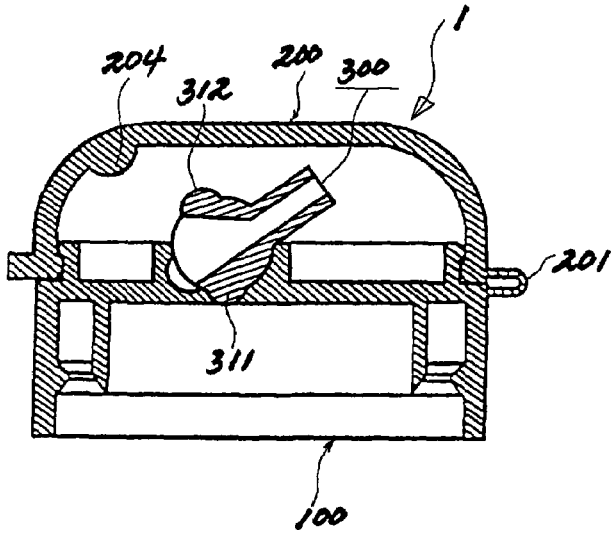
FIG. 9 is a sectional assembly view of the cap in a third embodiment according to the present invention.

FIG. 9 shows that the spout 300 is assemble thereto and the cover 200 is closed.

In this state, although the cover 200 is open, the content of the container is protected from the outer air. After opening the cover 200, as the spout 300 moves to the opposition of the hinge portion 201, the first sealing protrusion 311 is elastically released from the sealing protrusion inserting hole 114 and the second sealing protrusion 312 is positioned in the sealing protrusion inserting groove 115 so that the spout is maintained in a predetermined angle. Those are illustrated in FIG. 10.

In this state, if the container applying the cap 1 is inclined in a direction and the outer pressure is applied to a side surface of the container, the content of the container is dispensed through the outflow hole 104 and the central passage 309.

Figure 10:
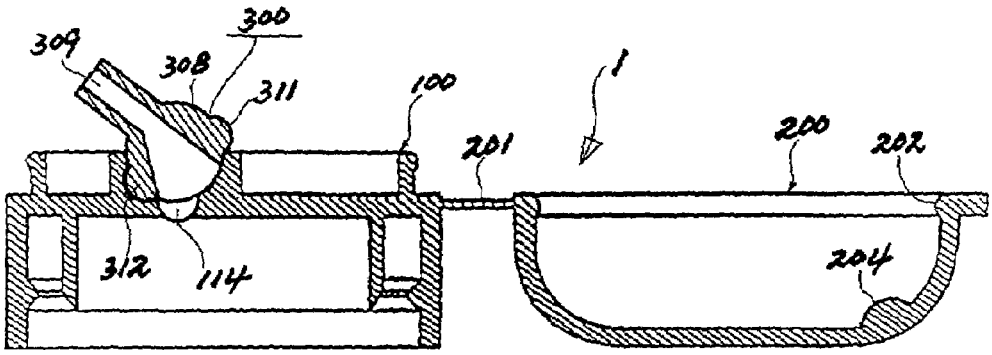
FIG. 10 is a sectional view that the cap is in using state according to the third embodiment of the present invention.

In state of FIG. 10, as the cover 200 is closed, the outflow hole sealing protrusion 204 closes the end of the central passage 309.

In the first to third embodiments of the invention, the user can reposition the cap at the initial position by the steps that he opens the cover 200 and then rotates or pushes the spout 300 or moves the spout aside thereby sealing the outflow holes 104 and 104' or the sealing protrusion inserting hole 114.

Further, the cap 1 of the present invention can be provided with an opening identification skirt for identifying the opening.

However, it is preferred that a shrink film is covered around the top surface of the cap 1.

Further, in the third embodiment of the present invention, a thin film can be applied to the position around the first sealing protrusion 311 and the user can tear the thin film by lifting the spout 300.

Fourth Embodiment

Figure 12:
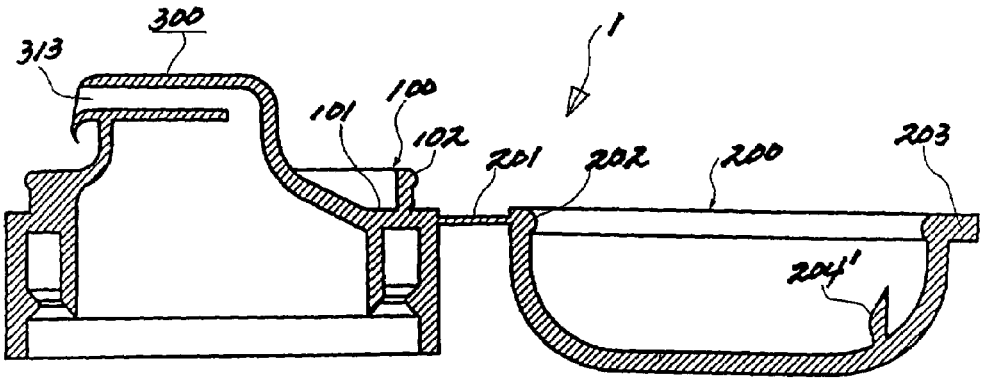
FIGS. 12 and 13 shows the cap in a fourth embodiment according to the present invention.
Figure 13:
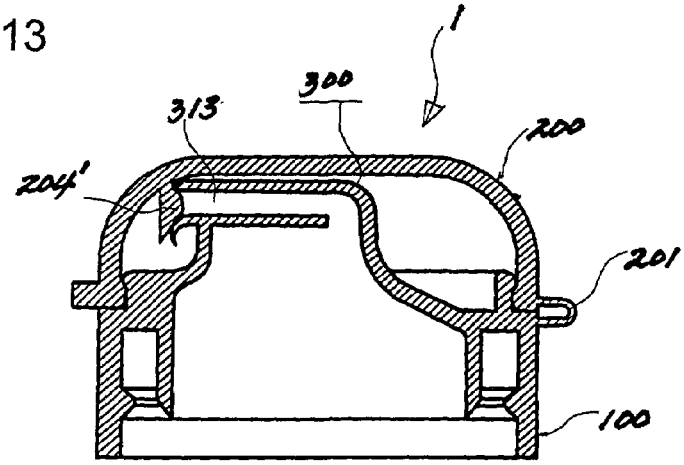

FIGS. 12 and 13 shows another embodiment of the pressure dispensing cap according to the present invention.

The main body 100 is designed such that a cover fixing band 102 is formed at the top surface of the main body and a spout 300 having an outflow hole 313 is formed inside of the cover fixing band 102 wherein the spout 300 is tilted in a right angle.

A cover 200 is connected to the main body 100 through the hinge portion 201, wherein an annular jaw 202 is formed at the upper end of the inner side of the cover 200 and an outflow hole closing protrusion 204' for closing the end of the outflow hole 313 of the spout 300 is formed near the guide portion 203.

Now, the operation of the present invention will be described below.

If the cover 200 is closed in state of FIG. 12, the outflow hole closing protrusion 204' elastically closes the end of the outflow hole 313 thereby preventing the cover 200 from being open.

That is, although an inner pressure is applied to the outflow hole 313, since the outflow hole closing protrusion 204' is horizontally formed, it is difficult that the cover is erected.

For an example, if the out flow hole 313 is inclined at a 70 to 80 degrees, the cover can be easily open.

It is preferred that the angle between the outflow hole 313 and the horizontal line is less than 7 degrees.

While this invention has been described in connection with what is presently considered to be the most practical and referred embodiments, it is to be understood that the invention is not limited to the disclosed embodiments, but, on the contrary, is intended to cover various modifications and equivalent arrangements included within the spirit and scope of the appended claims.

What is claimed is:

1. A pressure dispensing cap for liquid container comprising:

a main body coupled to a container;

a spout that is rotatably assembled to a spout fixing portion protruded from the main body; and a seal cover integrally formed with the main body and connected to the main body by a hinge portion, wherein a passage of the spout is closed by the main body when rotating to a first rotating position and is closed by the seal cover when rotating to a second rotating positions, wherein a curl shaped leakage preventing portion is formed at a lower end of a tube of the spout.

2. A pressure dispensing cap for liquid container as claimed in claim 1, wherein the spout fixing portion is provided with an outflow hole and a spout fixing protrusion at an upper portion and a lower portion thereof respectively.

3. A pressure dispensing cap for liquid container as claimed in claim 2, wherein a spout fixing protrusion fixing groove portion with a fixing groove is formed at both sides of the spout fixing portion.

4. A pressure dispensing cap for liquid container as claimed in claim 2, wherein the outflow hole is opposed to the hinge portion connect the cover to the main body.

5. A pressure dispensing cap for liquid container as claimed in claim 1, wherein the spout is provided at its inside with a spout fixing portion inserting groove, the spout fixing portion inserting groove is connected to the outflow portion formed in an inclined tube, and a spout fixing protrusion inserting groove is formed at the inner wall of the spout fixing portion inserting groove.

6. A pressure dispensing cap for liquid container as claimed in claim 5, wherein a fixing protrusion for elastically fixing to an inner groove of the spout fixing protrusion fixing groove is formed at an outer end of the lower portion of the spout.

7. A pressure dispensing cap for liquid container as claimed in claim 5, wherein the spout is assembled to the spout fixing portion and the tube of the spout is opposed to an outflow hole of the spout fixing portion.

8. A pressure dispensing cap for liquid container as claimed in claim 1, wherein an outflow hole closing protrusion is formed near a guide portion of the cover where the outflow hole closing protrusion closes the end of an outflow hole of the spout when the outflow hole of the spout aligns with an outflow hole of the spout fixing portion.

9. A pressure dispensing cap for liquid container as claimed in claim 1, wherein the spout is rotatably coupled with the spout fixing portion.

10. A pressure dispensing cap for liquid container as claimed in claim 9, wherein a spout fixing protrusion fixing portion is positioned in a corresponding place to a fixing protrusion so that the rotated position of the spout is controlled by the fixing protrusion.

11. A pressure dispensing cap for liquid container as claimed in claim 1, wherein an opening identification skirt is formed downward of the spout.

* * * * *